US005638546A

United States Patent [19]

Vita

[11] Patent Number: 5,638,546

[45] Date of Patent: Jun. 17, 1997

[54] ARM WARMER GARMENT

[76] Inventor: Deborah C. Vita, 50 Guilford Park Dr., West Babylon, N.Y. 11704

[21] Appl. No.: 555,390

[22] Filed: Nov. 9, 1995

[51] Int. Cl.[6] ..... A41D 13/08

[52] U.S. Cl. ..... 2/16; 2/59; 2/459

[58] Field of Search ..... 2/16, 59, 45, 268, 2/170, 2, 126, 125, 459

[56] References Cited

U.S. PATENT DOCUMENTS

| | | | |
|---|---|---|---|
| 731,791 | 6/1903 | Krifka | 2/16 |
| 1,117,077 | 11/1914 | Mooney | 2/16 |
| 1,149,674 | 8/1915 | Nichols | 2/59 |
| 1,285,917 | 11/1918 | Bradley et al. | 2/59 |
| 2,045,157 | 6/1936 | Mathias | 2/59 |
| 4,330,887 | 5/1982 | White | 2/16 |
| 4,356,570 | 11/1982 | Vernon et al. | 2/59 |
| 4,665,562 | 5/1987 | Winer | 2/59 |
| 4,784,128 | 11/1988 | Scheuermann | 2/45 |
| 4,951,317 | 8/1990 | Gray et al. | 2/16 |
| 4,985,934 | 1/1991 | Perry | 2/16 |
| 5,035,001 | 7/1991 | Novick | 2/16 |
| 5,173,967 | 12/1992 | Carter | 2/16 |
| 5,357,633 | 10/1994 | Rael | 2/16 |

*Primary Examiner*—Amy B. Vanatta
*Attorney, Agent, or Firm*—Michael I. Kroll

[57] ABSTRACT

An arm warmer garment (10) worn on an arm (12) of an athlete (14) to retain a substantial amount of body heat comprising a protective flexible sleeve (16) adapted to cover the arm (12) of the athlete (14) from a wrist (18) all the way up to a shoulder (20). A facility (22) is for securing the protective flexible sleeve (16) in place on the arm (12) of the athlete (14). The protective flexible sleeve (16) will stay on the arm (12) and maintain the temperature of muscles needed by the athlete (14) in the arm (12) for throwing an object (24), when the athlete (14) is idle during a sporting game.

17 Claims, 2 Drawing Sheets

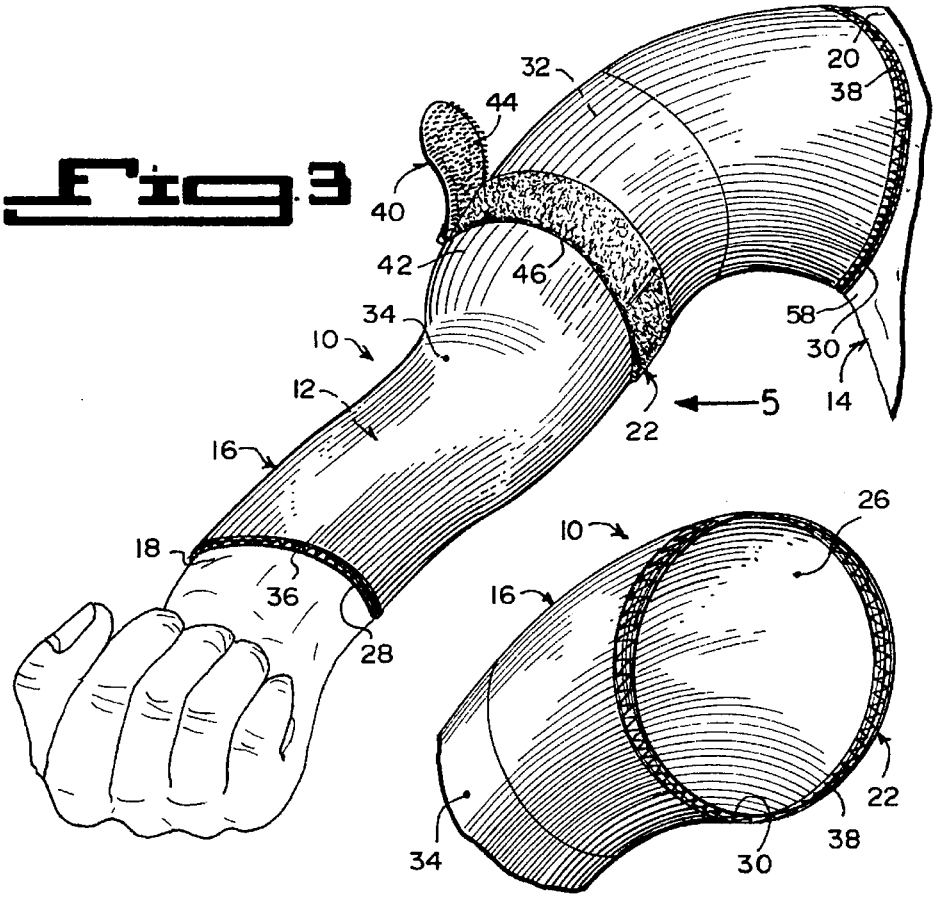
Fig. 3
Fig. 4
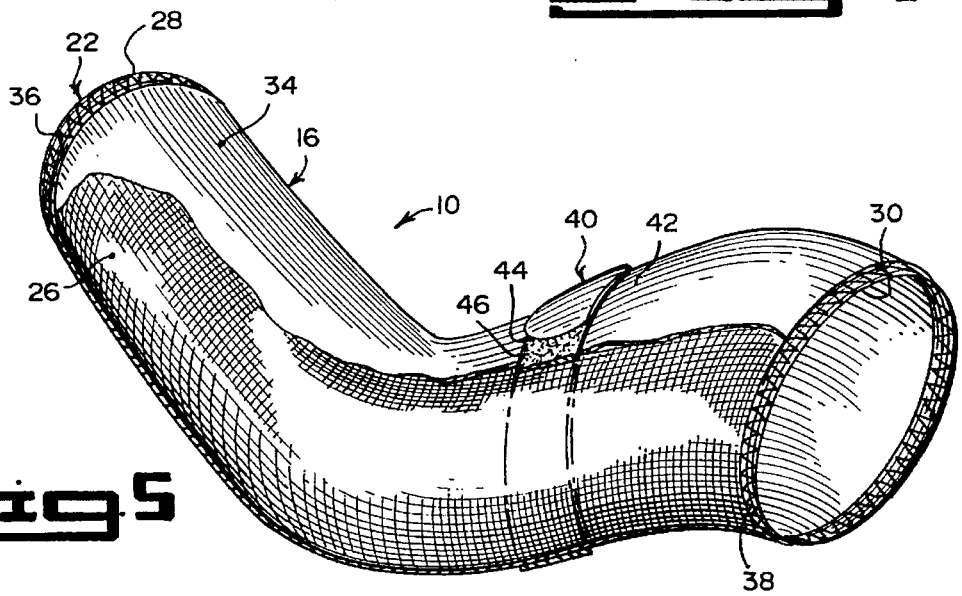
Fig. 5

ARM WARMER GARMENT

BACKGROUND OF THE INVENTION

1. Field of the Invention

The instant invention relates generally to limb protective apparel and more specifically it relates to an arm warmer garment.

2. Description of the Prior Art

Numerous line protective apparel have been provided in prior art. For example U.S. Pat. No. 4,951,317 to Gray et al.; U.S. Pat. No. 5,035,001 to Novick; U.S. Pat. No. 5,173,967 to Carter and U.S. Pat. No. 5,357,633 to Rael While these units may be suitable for the particular purpose to which they address, they would not be as suitable for the purposes of the present invention as heretofore described.

GRAY, ALFRED H.

VAUGHN, ROSE A.

Athletic Sleeve for Protecting Limbs

U.S. Pat. No. 4,951,317

This invention relates to an article of clothing which can be worn by athletes to protect their arm muscles, or lower leg muscles, from the damaging affects of cold air or cold wind. This pull on and off sleeve, helps to prevent muscles from tightening or cramping, by eliminating exposure to cold air and wind. This invention does not press upon arm or leg muscles, or restrict elbow motion in any way. The athletic sleeve, which can be removed in less than one second, is so small that it can be carried in any pocket.

NOVICK, CARL A.

Hot Sleeve, and Methods of Constructing and Utilizing Same

U.S. Pat. No. 5,035,001

The garment for use by athlete for retaining body heat adjacent to the arm and shoulder muscles and the major muscles utilized while throwing an object. The throwing motion utilizes the upper back and torso muscles in addition to the shoulder and arm muscles. Thus, it is desirable to retain body heat on these muscles to prevent them for "tightening up" while the athlete is idle, such as between innings of a baseball game.

CARTER, JAMES E.

Leg and Arm Protector

U.S. Pat. No. 5,173,967

A protective leg or arm covering is manufactured from a single piece of material. The material is cut into a blank having the shape to fit the purpose needed to protect the portion of the leg or arm desired. It is designed to be wrapped around the leg or arm, securing snugly but comfortably in the area of protection from the top of the leg or arm with the lateral edges extending to the bottom of the leg or arm or any partial area in between. A hook and pile closure sewn at the corners of the top and the bottom elevations of the blank of material provides the user with adjustability to the desired snugness of the fit. A hook and pile closure sewn along the lateral edges of the blank of material provides the user with full or partial protection from anything that would penetrate or enter the opening along the lateral edges. The device is lightweight, having no metal strips for support or other heavy objects required in its construction, requires nothing to be removed on the leg, foot, or arm to be attached securely to the leg or arm of the wearer, and is quick and easy to put on and take off.

RAEL, GEORGE V.

Arm Protective Garment

U.S. Pat. No. 5,357,633

An arm protective garment includes an elongated tubular sleeve made of a flexible fabric and defining an elongated internal cavity extending between opposite ends. The sleeve is open at one end for slipping over a driver's hand and arm and for receiving the driver's arm in the internal cavity of the sleeve. The garment also includes a mitten of flexible fabric disposed on the other end of the sleeve and defining an internal pocket for receiving the driver's hand therein. The mitten has only a thumb opening defined therein for extension of the driver's thumb for the mitten. The garment further includes a flexible strap attached to the one open end of the sleeve for encircling the neck or chest of the driver for releasable reattachment to the one open end of the sleeve to retain the sleeve on the driver's arm.

SUMMARY OF THE INVENTION

A primary object of the present invention is to provide an arm warmer garment that will overcome the shortcomings of the prior art devices.

Another object is to provide an arm warmer garment that will give thermal protection to an arm and shoulder of an athlete, so as to maintain body heat when the athlete is idle, such as a baseball pitcher between innings.

An additional object is to provide an arm warmer garment that can comfortably and adjustably fit onto the arm and shoulder of the athlete and be retained thereto, so that it will not slip off.

A further object is to provide an arm warmer garment that is simple and easy to use.

A still further object is to provide an arm warmer garment that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 3 is a perspective view taken in the direction of arrow 3 in FIG. 2, with the shoulder protective pad broken away.

FIG. 4 is a perspective view taken in the direction of arrow 4 in FIG. 2 of the instant invention per se with parts broken away.

FIG. 5 is a perspective view taken in the direction of arrow 5 in FIG. 3 of the instant invention per se with parts broken away.

Similar reference characters denote corresponding features consistently throughout the attached drawings.

DETAILED DESCRIPTION OF THE PREFERRED EMBODIMENTS

Figure 1:
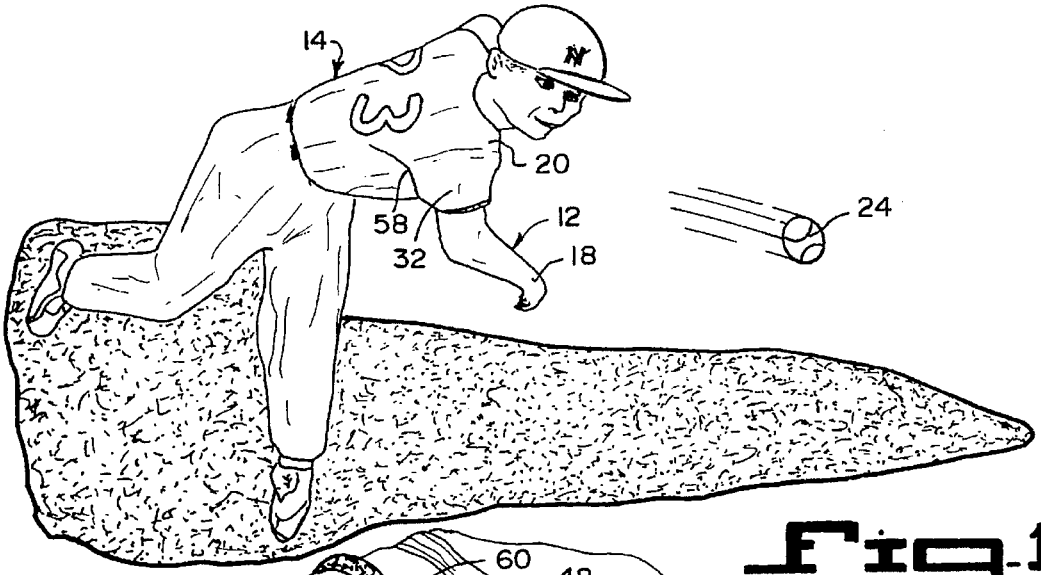
FIG. 1 is a perspective view showing a baseball pitcher throwing a baseball.

Turning now descriptively to the drawings, in which similar reference characters denote similar elements throughout the several views, FIGS. 2 through 5 illustrate an arm warmer garment 10 worn on an arm 12 of an athlete 14 to retain a substantial amount of body heat comprising a protective flexible sleeve 16 adapted to cover the arm 12 of the athlete 14 from a wrist 18 all the way up to a shoulder 20.

A facility 22 is for securing the protective flexible sleeve 16 in place on the arm 12 of the athlete 14. The protective flexible sleeve 16 will stay on the arm 12 and maintain the temperature of muscles needed by the athlete 14 in the arm 12, for throwing an object 24 when the athlete 14 is idle during a sporting game. The athlete 14, as shown in FIG. 1, is a baseball pitcher while the object 24 being thrown is a baseball.

The protective flexible sleeve 16 includes a generally tubular inner insulated fabric enclosure 26, having a first open end 28 for the wrist 18 of the arm 12 and a second open end 30 for an upper arm 32 of the arm 12 (see FIG. 5). A generally tubular outer covering fabric enclosure 34 extends from the first open end 28 to the second open end 30 of the generally tubular inner insulated enclosure 26.

The securing facility 22 contains a first resilient elastomeric band 36, fixed about the protective flexible sleeve 16 at the wrist 18 of the arm 12. A second resilient elastomeric band 38 is fixed about the protective flexible sleeve 16 at the upper arm 32 of the arm 12.

The securing facility 22 also includes a VELCRO type fastening strap 40 that fits in an adjustable manner about a biceps area 42 of the protective flexible sleeve 16. The VELCRO type fastening strap 40 consists of a hook element 44 on a first end and an elongated loop pile element 46 on a second end. The hook element 44 and the elongated loop pile element 46 can be placed in an adjustable manner into a mating aligned juxtaposed overlapping position.

Figure 2:
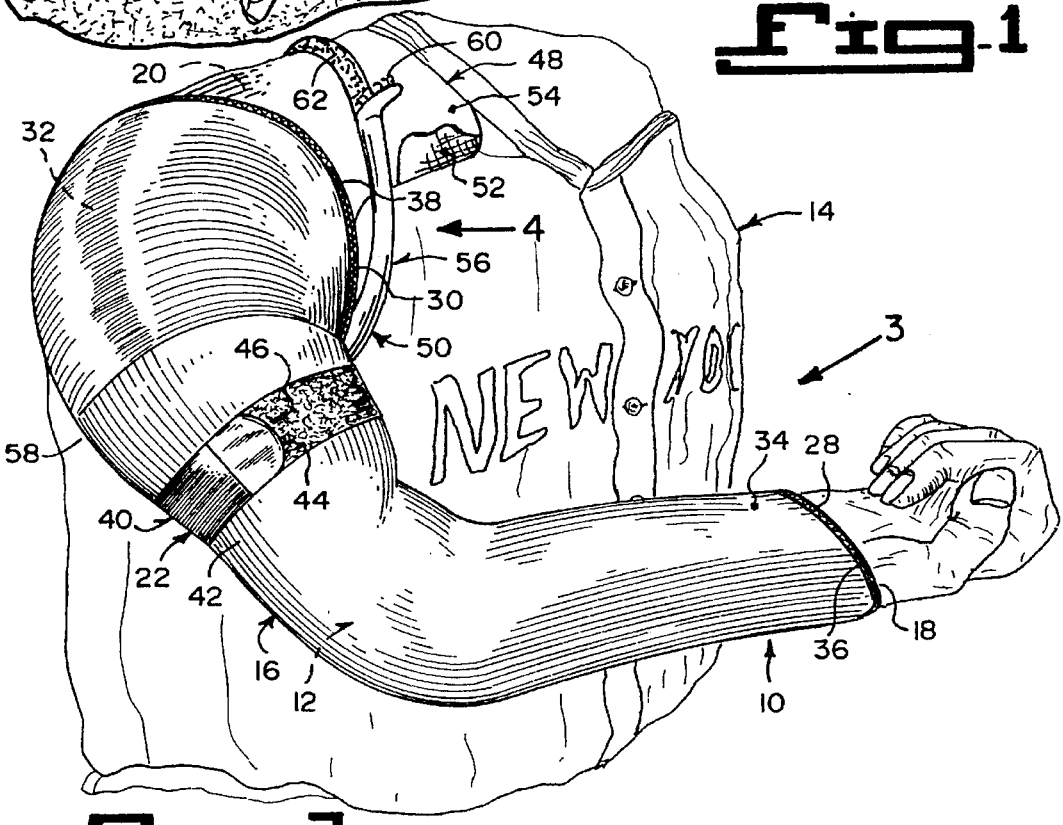
FIG. 2 is a perspective view of a portion of the baseball pitcher wearing the instant invention.

As shown in FIG. 2, the arm warmer garment 10 can further include a protective flexible shoulder pad 48 affixed to and extending from the protective flexible sleeve 16 at an upper arm 32 of the arm 12, so as to cover the shoulder 20 of the athlete 14. A component 50 is for retaining the protective flexible shoulder pad 48 in place on the shoulder 20 of the athlete 14. The protective flexible pad 48 will stay on the shoulder 20 and maintain the temperature of muscles needed by the athlete 14 in the shoulder 20, for throwing the object 24 when the athlete 14 is idle during the sporting game.

The protective flexible shoulder pad 48 includes a generally rectangular inner insulated fabric sheet 52. A generally rectangular outer covering fabric sheet 54 extends over the generally rectangular inner insulated fabric sheet 52.

The retaining component 50 is a VELCRO type fastening belt 56 that fits in an adjustable manner about an armpit 58 of the athlete 14, and over the protective flexible shoulder pad 48. The VELCRO type fastening belt 56 consists of a hook element 60 on a first end and an elongated loop pile element 62 on a second end. The hook element 60 and the elongated loop pile element 62 can be placed in an adjustable manner into a mating aligned juxtaposed overlapping position on the protective flexible shoulder pad 48.

OPERATION OF THE INVENTION

To use the arm warmer garment 10, the athlete 14 must follow the steps below:

1. Insert the arm 12 through the protective flexible sleeve 16, so that it covers the arm 12 from the wrist 18 all the way up to the shoulder 20.
2. Place the first resilient elastomeric band 36 at the wrist 18 of the arm 12.
3. Position the second resilient elastomeric band 38 at the upper arm 32 of the arm 12.
4. Tighten the VELCRO type fastening strap 40 about the biceps area 42 of the protective flexible sleeve 16, so that the hook element 44 engages with the elongated loop pile element 46.
5. Put the protective flexible shoulder pad 48 over the shoulder 20.
6. Warp the VELCRO type fastening belt 56 about the armpit 58 and over the protective flexible shoulder pad 48, so that the hook element 60 engages with the elongated loop pile element 62.

LIST OF REFERENCE NUMBERS

10 arm warmer garment
12 arm of 14
14 athlete (baseball pitcher)
16 protective flexible sleeve of 10
18 wrist of 12
20 shoulder of 14
22 securing facility for 16
24 object (baseball)
26 generally tubular inner insulated fabric enclosure of 16
28 first open end of 26
30 second open end of 26
32 upper arm of 12
34 generally tubular outer covering fabric enclosure of 16
36 first resilient elastomeric band of 22
38 second resilient elastomeric band of 22
40 VELCRO type fastening strap of 22
42 biceps area of 16
44 hook element of 40
46 elongated loop pile element of 40
48 protective flexible shoulder pad of 10
50 retaining component for 48
52 generally rectangular inner insulated fabric sheet of 48
54 generally rectangular outer covering fabric sheet of 48
56 VELCRO type fastening belt for 50
58 armpit of 14
60 hook element of 56
62 elongated loop pile element of 56

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An arm warmer garment worn on an arm of an athlete to retain a substantial amount of body heat comprising:

a) a protective flexible sleeve adapted to cover the arm of the athlete from a wrist all the way up to a shoulder;

b) means for securing said protective flexible sleeve in place on the arm of the athlete, so that said protective flexible sleeve will stay on the arm and maintain the temperature of muscles needed by the athlete in the arm for throwing an object when the athlete is idle during a sporting game;

c) a protective flexible shoulder pad affixed to and extending from said protective flexible sleeve at an upper portion of the arm, so as to cover a shoulder of the athlete; and d) means for retaining said protective flexible shoulder pad in place on the shoulder of the athlete, so that said protective flexible pad will stay on the shoulder and maintain the temperature of muscles needed by the athlete in the shoulder for throwing an object when the athlete is idle during a sporting game, wherein said retaining means includes a hook and loop type fastening belt that fits in an adjustable manner about an armpit of the athlete and over said protective flexible shoulder pad.

2. An arm warmer garment as recited in claim 1, wherein said protective flexible sleeve includes a generally tubular inner insulated fabric enclosure having a first open end for the wrist of the arm and a second open end at an upper portion of the arm.

3. An arm warmer garment as recited in claim 2, wherein said protective flexible sleeve further includes a generally tubular outer covering fabric enclosure extending from the first open end to the second open end of said generally tubular inner insulated enclosure.

4. An arm warmer garment as recited in claim 1, wherein said securing means includes a first resilient elastomeric band fixed about said protective flexible sleeve at the wrist of the arm.

5. An arm warmer garment as recited in claim 1, wherein said securing means includes a resilient elastomeric band fixed about said protective flexible sleeve at the upper portion of the arm.

6. An arm warmer garment as recited in claim 1, wherein said securing means includes a hook and loop type fastening strap that fits in an adjustable manner about a biceps area of said protective flexible sleeve.

7. An arm warmer garment as recited in claim 6, wherein said hook and loop type fastening strap includes:

a) a hook element on a first end; and b) an elongated loop pile element on a second end, so that said hook element and said elongated loop pile element can be placed in an adjustable manner into a mating aligned juxtaposed overlapping position.

8. An arm warmer garment as recited in claim 1, wherein said protective flexible shoulder pad includes a generally rectangular inner insulated fabric sheet.

9. An arm warmer garment as recited in claim 8, wherein said protective flexible shoulder pad further includes a generally rectangular outer covering fabric sheet extending over said generally rectangular inner insulated fabric sheet.

10. An arm warmer garment as recited in claim 1, wherein said hook and loop type fastening belt includes:

a) a hook element on a first end; and b) an elongated loop pile element on a second end, so that said hook element and said elongated loop pile element can be placed in an adjustable manner into a mating aligned juxtaposed overlapping position on said protective flexible shoulder pad.

11. An arm warmer garment worn on an arm of an athlete to retain a substantial amount of body heat comprising:

a) a protective flexible sleeve adapted to cover the arm of the athlete from a wrist all the way up to a shoulder and having 1) a generally tubular inner insulated fabric enclosure having a first open end for the wrist of the arm and a second open end at an upper portion of an arm and 2) a generally tubular outer covering fabric enclosure extending from the first open end to the second open end of said generally tubular inner insulated enclosure; and b) means for securing said protective flexible sleeve in place on the arm of the athlete, so that said protective flexible sleeve will stay on the arm and maintain the temperature of muscles needed by the athlete in the arm for throwing an object when the athlete is idle during a sporting game, wherein said securing means includes 1) resilient elastomeric bands fixed about said protective sleeve at the wrist of the arm and at the upper portion of the arm, and 2) a hook and loop type fastening strap that fits in an adjustable manner about a biceps area of said protective flexible sleeve.

12. An arm warmer garment as recited in claim 11, wherein said hook and loop type fastening strap includes:

a) a hook element on a first end; and b) an elongated loop pile element on a second end, so that said hook element and said elongated loop pile element can be placed in an adjustable manner into a mating aligned juxtaposed overlapping position.

13. An arm warmer garment as recited in claim 12, further including:

a) a protective flexible shoulder pad affixed to and extending from said protective flexible sleeve at an upper portion of the arm, so as to cover a shoulder of the athlete; and b) means for retaining said protective flexible shoulder pad in place on the shoulder of the athlete, so that said protective flexible pad will stay on the shoulder and maintain the temperature of muscles needed by the athlete in the shoulder for throwing an object when the athlete is idle during a sporting game.

14. An arm warmer garment as recited in claim 13, wherein said protective flexible shoulder pad includes a generally rectangular inner insulated fabric sheet.

15. An arm warmer garment as recited in claim 14, wherein said protective flexible shoulder pad further includes a generally rectangular outer covering fabric sheet extending over said generally rectangular inner insulated fabric sheet.

16. An arm warmer garment as recited in claim 15, wherein said retaining means includes a hook and loop type fastening belt that fits in an adjustable manner about an armpit of the athlete and over said protective flexible shoulder pad.

17. An arm warmer garment as recited in claim 16, wherein said hook and loop type fastening belt includes:

a) a hook element on a first end; and b) an elongated loop pile element on a second end, so that said hook element and said elongated loop pile element can be placed in an adjustable manner into a mating aligned juxtaposed overlapping position on said protective flexible shoulder pad.

* * * * *